US007575639B2

(12) United States Patent
Cesak et al.

(10) Patent No.: US 7,575,639 B2
(45) Date of Patent: Aug. 18, 2009

(54) APPARATUS AND METHOD FOR PROCESSING SHEET MATERIALS

(75) Inventors: James Cesak, Westchester, IL (US); Arun Ramabadran, Naperville, IL (US)

(73) Assignee: Spraying Systems Co., Wheaton, IL (US)

( * ) Notice: Subject to any disclaimer, the term of this patent is extended or adjusted under 35 U.S.C. 154(b) by 842 days.

(21) Appl. No.: 10/910,842

(22) Filed: Aug. 3, 2004

(65) Prior Publication Data

US 2006/0029742 A1 Feb. 9, 2006

(51) Int. Cl.
*B05C 5/02* (2006.01)
*B05C 19/04* (2006.01)
*B05D 1/02* (2006.01)

(52) U.S. Cl. ..... 118/663; 118/664; 118/665; 118/666; 118/708; 118/712; 118/69; 118/308; 118/313

(58) Field of Classification Search ..... 118/666, 118/708, 712, 69, 308, 313–316; 62/63–65, 62/171; 162/207, 198, 290, 263; 34/114, 34/122; 239/67–70, 418, 423, 424, 424.5, 239/536; 222/146.6; 427/374.1, 186
See application file for complete search history.

(56) References Cited

U.S. PATENT DOCUMENTS

| | | | | |
|---|---|---|---|---|
| 2,892,308 | A * | 6/1959 | Ferri et al. | 239/132 |
| 3,197,529 | A * | 7/1965 | Greiner | 264/643 |
| 4,785,646 | A * | 11/1988 | Uekaji et al. | 72/8.5 |
| 2002/0112520 | A1 * | 8/2002 | Rodgers | 72/286 |
| 2003/0089798 | A1 * | 5/2003 | Hofherr et al. | 239/432 |

* cited by examiner

*Primary Examiner*—Laura Edwards
(74) *Attorney, Agent, or Firm*—Leydig, Voit & Mayer, Ltd.

(57) ABSTRACT

An apparatus and method for processing elongated sheet material through a plurality of processing stations including a cooling station for lowering the temperature of the sheet material. The cooling station includes a plurality of individually controllable cooling zones each for controlling a portion of the transverse width of the sheet material during passage through the cooling zone. The cooling zones each include a plurality of cooling fluid directing spray nozzles and a sensor for sensing the temperature of the portion of the sheet material onto which cooling fluid has been directed by the respective cooling zone. A controller responsive to the temperature sensed at each cooling zone is operable for independently controlling the flow of cooling fluid to the fluid spray nozzles of each cooling zone based upon a preset temperature setting of the controller.

39 Claims, 8 Drawing Sheets

APPARATUS AND METHOD FOR PROCESSING SHEET MATERIALS

FIELD OF THE INVENTION

The present invention relates generally to the manufacture and processing of products made from a moving web or other continuous sheet material, and more particularly, to an apparatus and method for uniformly applying processing mediums onto the moving sheet material. The invention has particular utility in uniformly cooling heated web or sheet material as it is moved through a processing line.

BACKGROUND OF THE INVENTION

Various web or sheet formed products manufactured on a continuous basis either often are heated during processing, or are subjected to the application of heated materials, so as to necessitate cooling of the web during its travel through the processing line. For example, roofing materials, such as asphalt shingles, commonly are produced in a process line in which a web of sheet material, made of organic or fiberglass material, is drawn from a supply roll through (1) a coating station in which the web is coated with a hot liquid tar or asphalt, (2) a surfacing station in which granular surface material is directed onto the hot liquid coating, (3) a cooling and press roll station in which the granular surface material is pressed into the hot liquid coating and the sheet material and coating are cooled by spraying a cooling liquid, such as water, onto the moving sheet material, and (4) cutting and stacking stations in which the cooled sheet material is cut into predetermined-size shingles and stacked. Inconsistencies in processing conditions can significantly affect the quality of the finished shingle product.

Cooling the moving sheet material and hot liquid coating at the cooling station in such asphalt production lines has been particularly problem prone. Unevenness in cooling of the sheet material can significantly affect the quality and consistency of the resulting product, and particularly the extent of granular penetration and retention in the coating. Inadequate or excessive cooling of the web entering the cutting and subsequent stacking stations also can cause jamming, production interruption and rejected product. Heretofore, systems for cooling such web based products typically use manually controlled spray headers in the form of a pipe which positions a plurality of coolant directing spray nozzles across the width of the moving web. For a variety of reasons, in such cooling systems the temperature across the width of the moving web cannot be uniformly maintained. Since the headers are a fixed distance from the web, as the liquid spray pressure is varied for controlling cooling, the angle of the discharging spray can change considerably during processing. At lower pressures, a narrow spray angle can result in portions of the web being missed by the spray, while at higher pressures wider spray angles can create overlapping spray patterns. In each case, uneven cooling can occur across the width of the web.

When webs of different widths are processed in the same line it is even more difficult to uniformly cool the web across the width of the sheet material without major re-setup of the processing line. Non-uniformity in cooling also can occur by reason of the surrounding ambient conditions, such as if a door or window is open along one side of the processing line. Clogging of nozzles in the header further can result in significant temperature variations across the width of the moving web. To ensure sufficient cooling, operators typically error on directing excess cooling liquid, which results in costly waste and requires handling of the excessively applied liquid. Moreover, since the liquid spray headers typically are manually operated, following a shift changeover to a new operator, the character and quality of the finished product can vary significantly.

OBJECTS AND SUMMARY OF THE INVENTION

It is a primary object of the invention to provide an apparatus and method for applying processing mediums, such as cooling liquids, in a more uniform and controlled manner to a continuously moving web or sheet material.

A more particular object is to provide a system for more efficiently and uniformly cooling the web or sheet material in a continuous production or processing line.

A further object is to provide an automatically controlled cooling system adapted to uniformly cool moving web material in a processing line across the width of the web.

Yet another object is to provide a cooling system as characterized above which is adapted to uniformly cool moving web or sheet material notwithstanding clogging of one or more of the liquid spray nozzles.

Still another object is to provide a cooling system of the above kind which is adapted to automatically sense unevenness in temperatures across the width of a moving web and to adjust operation of the cooling system to effect uniform cooling.

Another object is to provide such a web cooling system which optimizes water usage and minimizes or eliminates handling of excessively applied cooling liquid.

Yet a further object is to provide a cooling system of the foregoing type which can be automatically adapted for uniformly cooling webs of different widths in a processing line.

A further object is to provide a cooling system of the above kind that is operable for initially cooling moving web material by one cooling technique (such as evaporative cooling) and subsequently more precisely cooling the moving web to a predetermined temperature by a second cooling technique (such as convective cooling).

Another object is to provide a cooling system of the foregoing type that is particularly adapted for use in making asphalt roofing materials within predetermined quality standards. A related object is to provide such a cooling system which enables continued uniform production of asphalt roofing material and the like even following shift changeovers.

Still a further object is to provide a web cooling system as indicated above which is relatively simple in construction and economical to implement.

Other objects and advantages of the invention will become apparent upon reading the following detailed description and upon reference to the drawings, in which:

BRIEF DESCRIPTIONS OF THE DRAWINGS

Figures 1A, 1B:
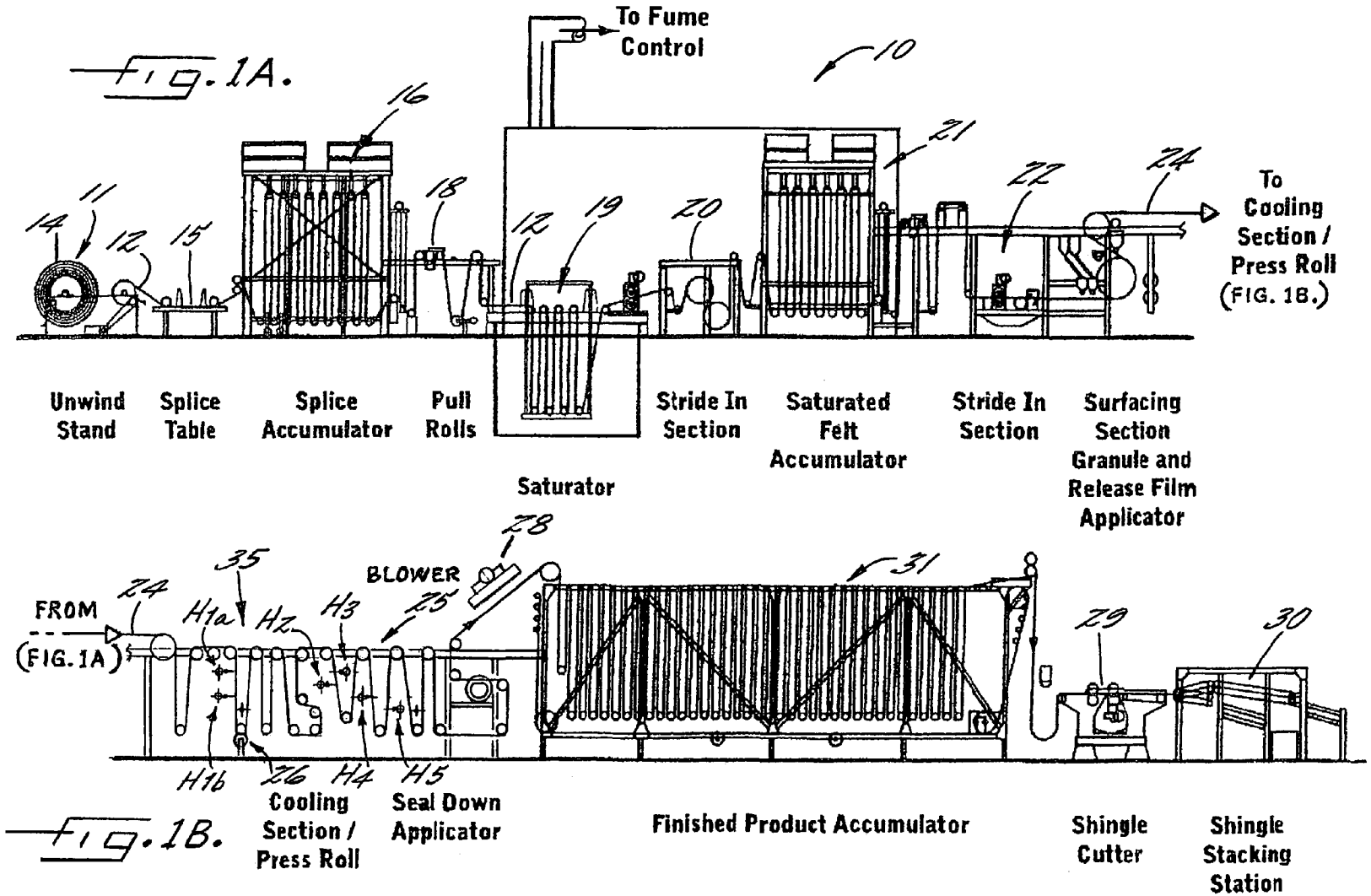
FIGS. 1A and 1B are a diagrammatic depiction of an illustrative asphalt shingle processing line having a web cooling system in accordance with the invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention. In that regard, it will be understood that while the invention will be described in connection with a cooling system for continuous sheet or web material, the invention has utility in applying any processing medium onto moving sheet material in a production line.

DETAILED DESCRIPTION OF PREFERRED EMBODIMENTS

Referring now more particularly to FIG. 1 of the drawings, there is shown in illustrative asphalt shingle manufacturing and processing line 10 having a processing medium application system, in this case in the form of a cooling system, in accordance with the invention. The asphalt shingle processing line 10 basically is of a conventional type, and it will be understood that while the invention will be disclosed and described in connection with the manufacture of asphalt shingles, the inventive cooling system may be used in other types of processing lines in which a continuous web or sheet of heated material is processed through a multiplicity of processing stations.

The illustrative asphalt shingle processing line 10 includes an unwind stand 11 in which a spool of a continuous web or sheet material 12, such as fiberglass or felt, is drawn from a takeout roll 14 over a splicing table 15 and through an accumulator 16 by means of pull rolls 18. The web 12, as shown in FIG. 1A, is directed in serpentine fashion through the accumulator 16, in which upper rolls thereof can be raised and lowered in a known manner for providing a continuous supply of sheet material to the processing line notwithstanding breakage or an interruption in the supply of material from the take-out roll 14. The web 12 is then drawn through a saturator 19 which contains a supply of hot asphalt or tar at elevated temperature, such as between about 385° and 420° F., which coat both sides of the web 12. The hot coated web 12 is then directed via a stride in or a feed station 20 to a further accumulator 21 and then via a stride in section 22 to a surfacing section 24 where granular material is released onto the hot coated web 12 which adheres thereto. The surfaced web 12 with the hot coating is thereupon directed to a cooling and press roll station 25 (FIG. 1B) which initially cools the coating and sheet material an initial amount prior to direction through a press roll 26, which presses the granule surface material into the hot coating. The web 12 then is cooled an additional in the cooling section 25 and dried by a blower 28, prior to direction to a shingle cutting and shingle stacking stations, 29, 30 via a finished product accumulator 31.

Proper cooling of the hot coated web 12 in the cooling and press roll station 25, as indicated above, is critical to uniform quality production of the finished shingle product. Inadequate cooling of the hot coated sheet material prior to passage through the press roll 26 can affect the uniformity and degree of granular penetration into the hot coated material. Likewise, non-uniform or inadequate cooling of the coated sheet material following passage through the press roll 26 can effect uniformity in granular retention and impede subsequent proper cutting and stacking of the finished shingles.

Figures 2, 3:
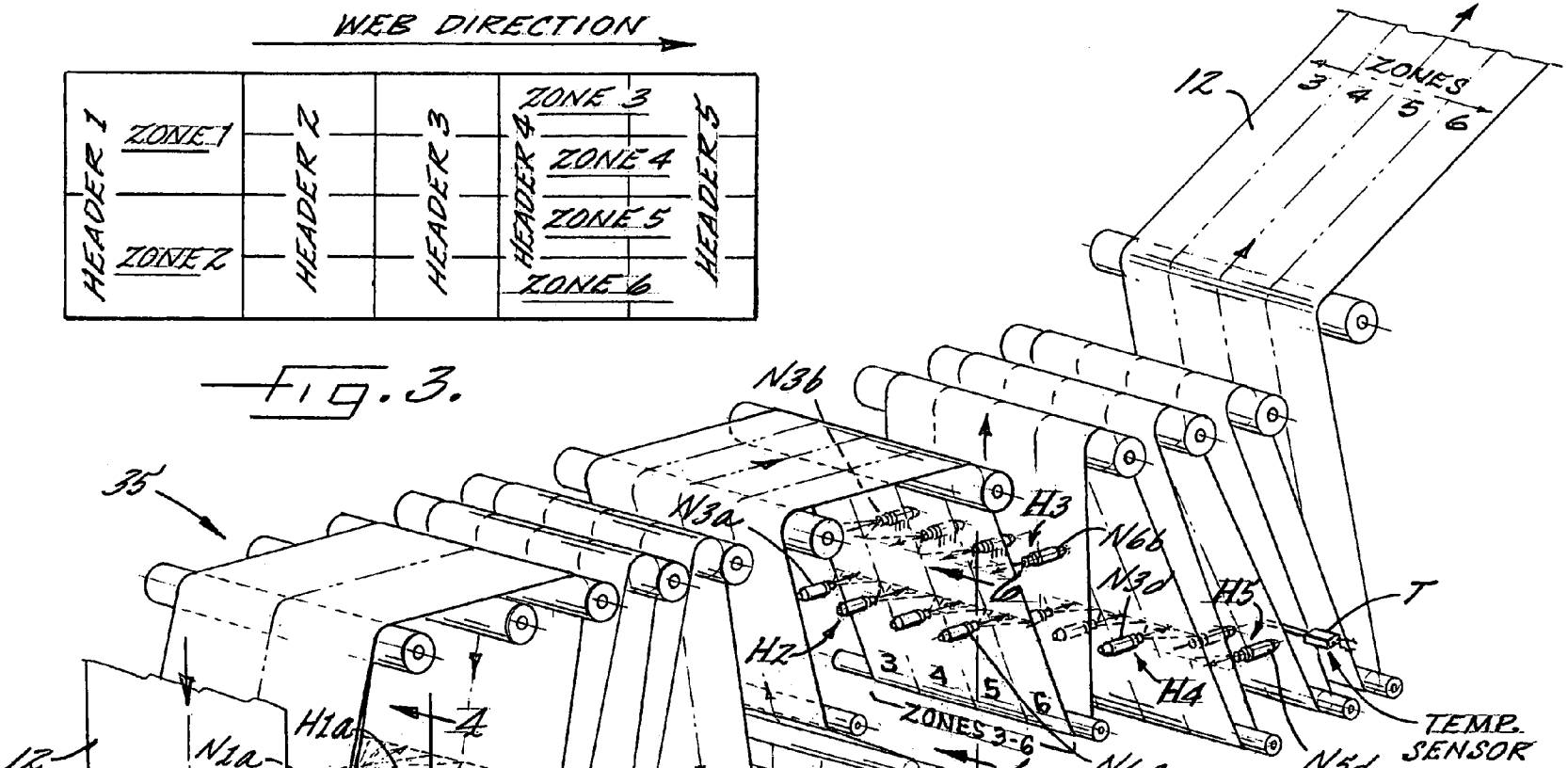
FIG. 2 is a perspective of the cooling system of the illustrated machine.
FIG. 3 is a diagrammatic depiction of the multiple cooling zones of the illustrated cooling system.
Figure 4:
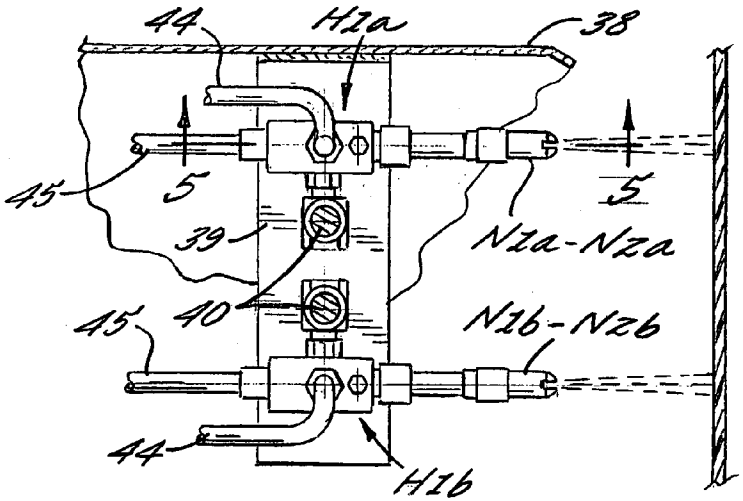
FIG. 4 is a vertical section of one of the initial cooling zones of the illustrated cooling system, taken in the plane of line 4-4 in FIG. 2.
Figure 5:
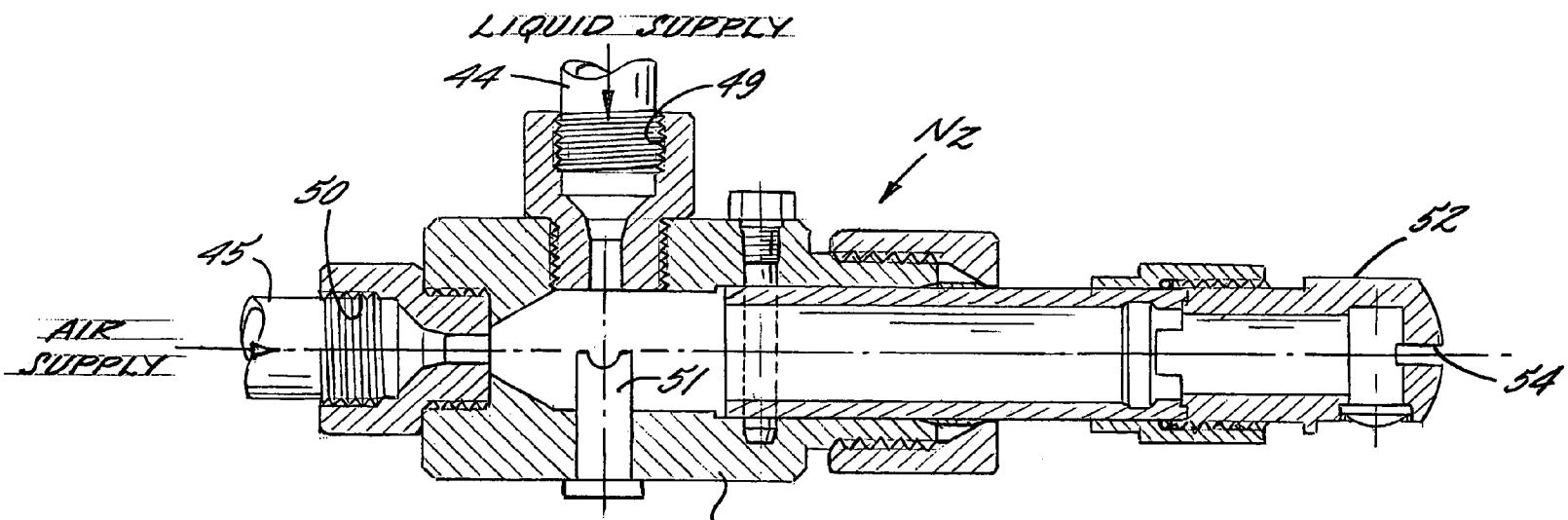
FIG. 5 is a longitudinal section of one of the spray nozzles or guns used in the initial cooling zones of the illustrated cooling system, taken in the plane of line 5-5 in FIG. 4.

In accordance with the invention, a process application system is provided which comprises a plurality of individually controlled process application zones for more uniformly applying a process medium, in this case a cooling medium, to the moving web material. More particularly, the process application system is in the form of a cooling system that comprises a plurality of cooling zones, each of which has a width less than the width of the moving web material and is independently controllable for effecting uniform cooling of the moving web across its entire width for proper further processing and efficient handling. The illustrated processing line 10 has a cooling system 35 that includes two initial independently controllable cooling zones Z1, Z2 at the cooling and press roll station 25 immediately prior to the press roll 26. The cooling zones Z1, Z2 each are operable for cooling a zone corresponding to one-half of the width of the moving web 12. The cooling zones Z1, Z2 in this instance each included two spray nozzles N1*a*, N1*b* and N2*a*, N2*b*, respectively, with the spray nozzles for each zone being disposed in vertically spaced relation to each other, as depicted in FIGS. 3 and 4.

The spray nozzles in zones Z1, Z2 are supported by common headers H1*a*, H1*b* with the upper spray nozzle N1*a*, N2*a* of each zone being supported by a first header H1*a* and the lower spray nozzle N1*b*, N2*b* of each zone being supported by a common lower header H1*b*. The illustrated headers H1*a*, H1*b* each comprise an inverted V-shaped channel 38 with end plates 39 between which a nozzle support rod 40 is mounted (FIG. 4). The support rod 40 for the upper header H1*a* carries the upper spray nozzles N1*a*, N1*b* for cooling zones Z1, Z2, and the support rod 40 for the lower header H1*b* similarly carries the lower spray nozzles for the cooling zones Z1, Z2.

The spray nozzles N1*a*, N1*b* and N2*a*, N2*b*, together their with respective pressurized liquid and air supply lines, 44, 45 for the nozzles, are disposed below the inverted channel 38 of the header for protection against potential damage in the event of accidental breakage of the moving web during processing. The pressurized liquid and air supply lines 44, 45 for the nozzles of each zone communicate with the main supply through a common manifold block 46, 47. The liquid supply lines 44 for the spray nozzle of each zone preferably are equal in length such that pressure losses through the liquid supply lines are the same for the nozzles of each zone.

The spray nozzles N1*a*, N1*b* and N2*a*, N2*b* for cooling zones Z1, Z2 are internal-mix, air-assisted spray nozzles, which may be of a type commercially available from Spraying Systems Company, assignee of the present application, under the model designation Castor Jet, such as disclosed in U.S. Pat. No. 6,726,127 which issued Apr. 27, 2004, the disclosure of which is incorporated herein by reference. Each spray nozzle has a nozzle body 48 with liquid and air inlet ports 49, 50, respectively, connected to the liquid and air supply lines 44, 45. Liquid is directed transversely into the nozzle body 48 into engagement with an impingement pin 51 for pre-atomization by a pressurized air stream longitudinally directed across the impingement pin 51. The pre-atomized liquid particles proceed through the nozzle for discharge from a spray tip 52 having a discharge orifice 54 of the desired configuration toward the moving web 12 for cooling the web.

In carrying out the invention, each cooling zone Z1, Z2 has a respective temperature sensor disposed downstream of the spray nozzles for sensing the condition of the web immediately after being cooled by the discharging sprays of the spray nozzles for the respective zone. In this case, the cooling zones Z1, Z2 each have a temperature sensor T immediately above the press roll 26. The temperature sensors T preferably are infrared temperature sensors of a known type oriented for detecting the temperature of the moving web at a central location within the respective cooling zone. As is known in the art, such temperature sensors are operable for generating an output analog signal in response to the sensed temperature.

Figure 9A:
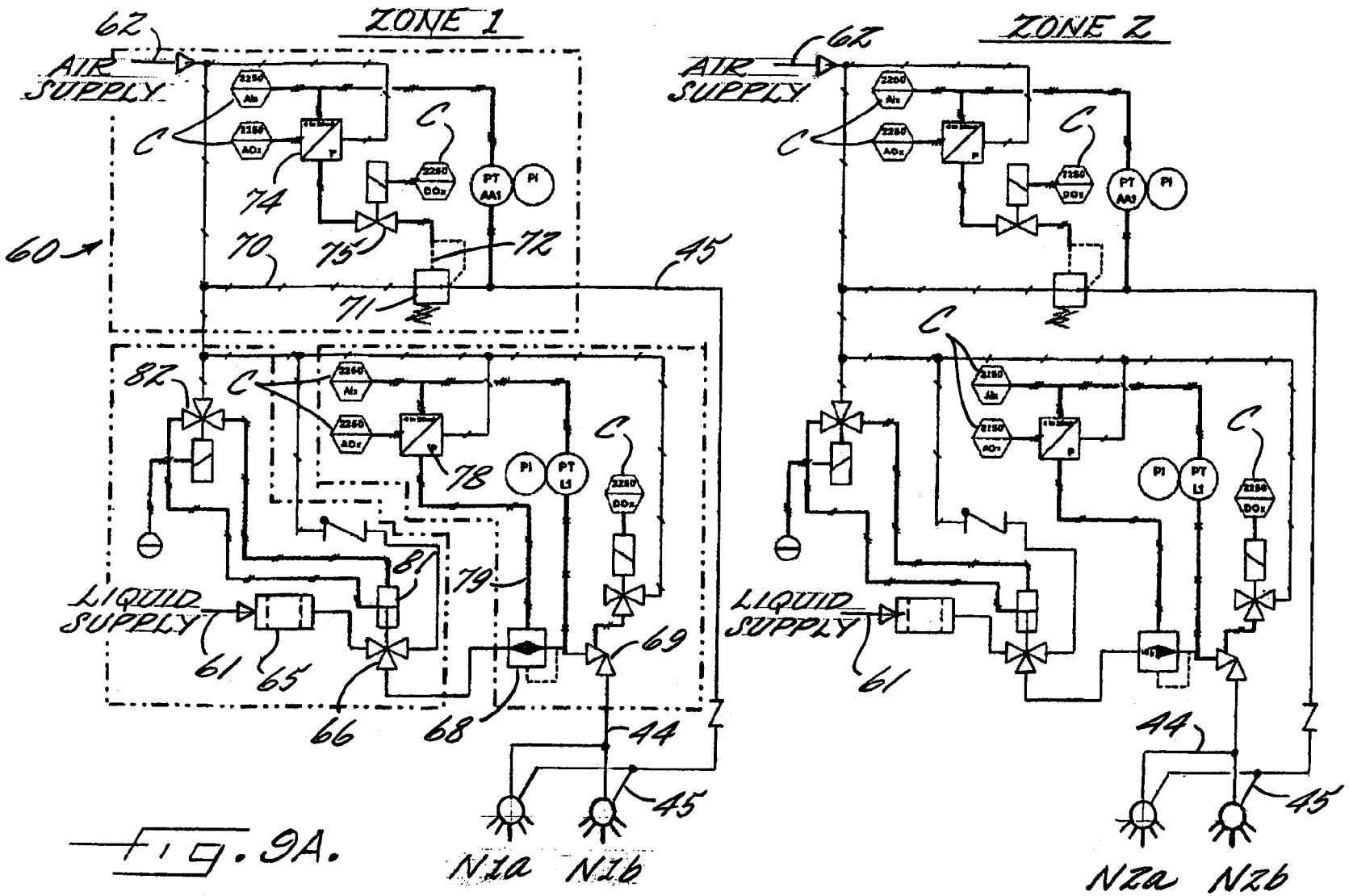
FIGS. 9A-9C is a diagram of the control for the illustrated cooling system.
Figure 9B:
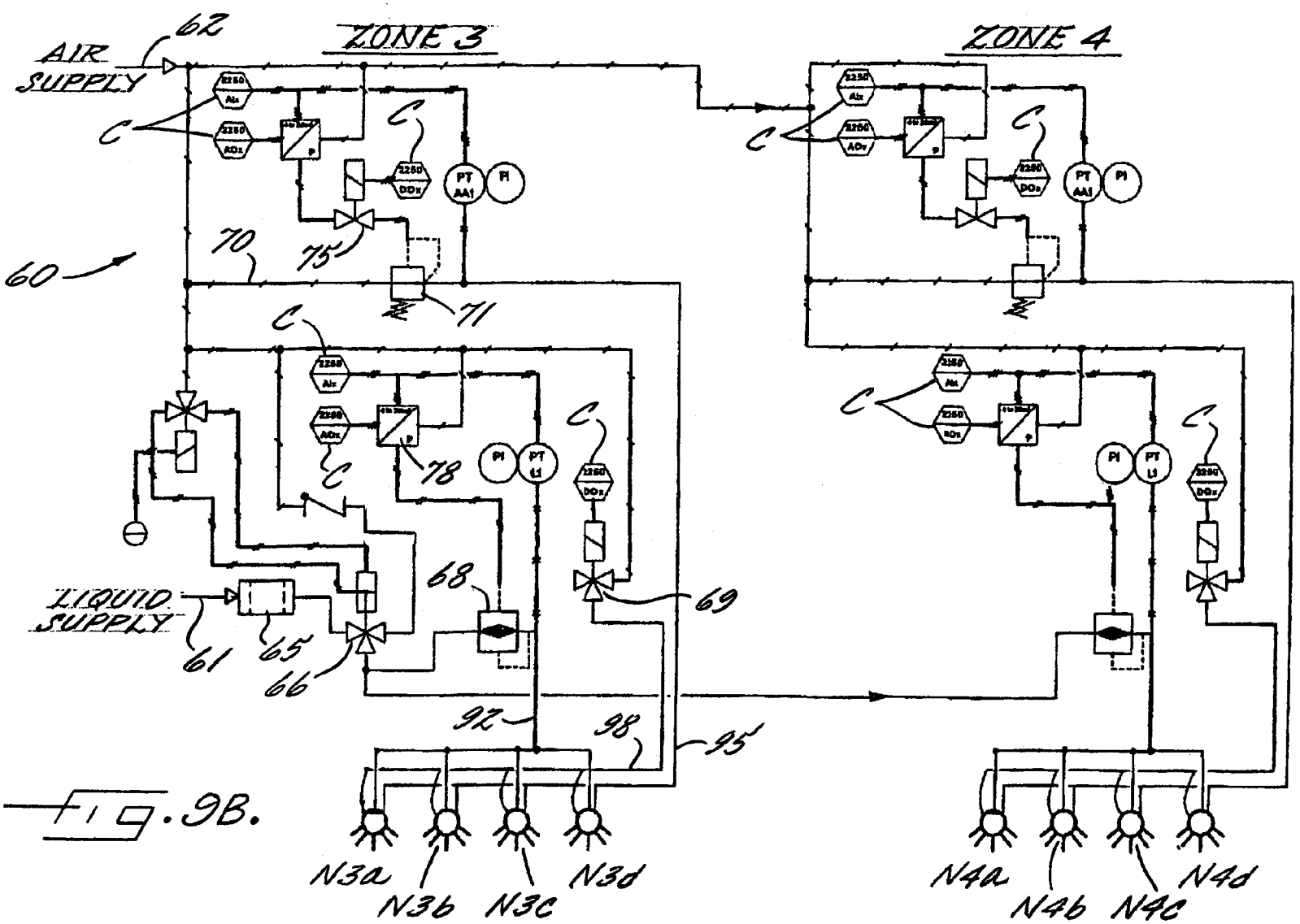
Figure 9C:
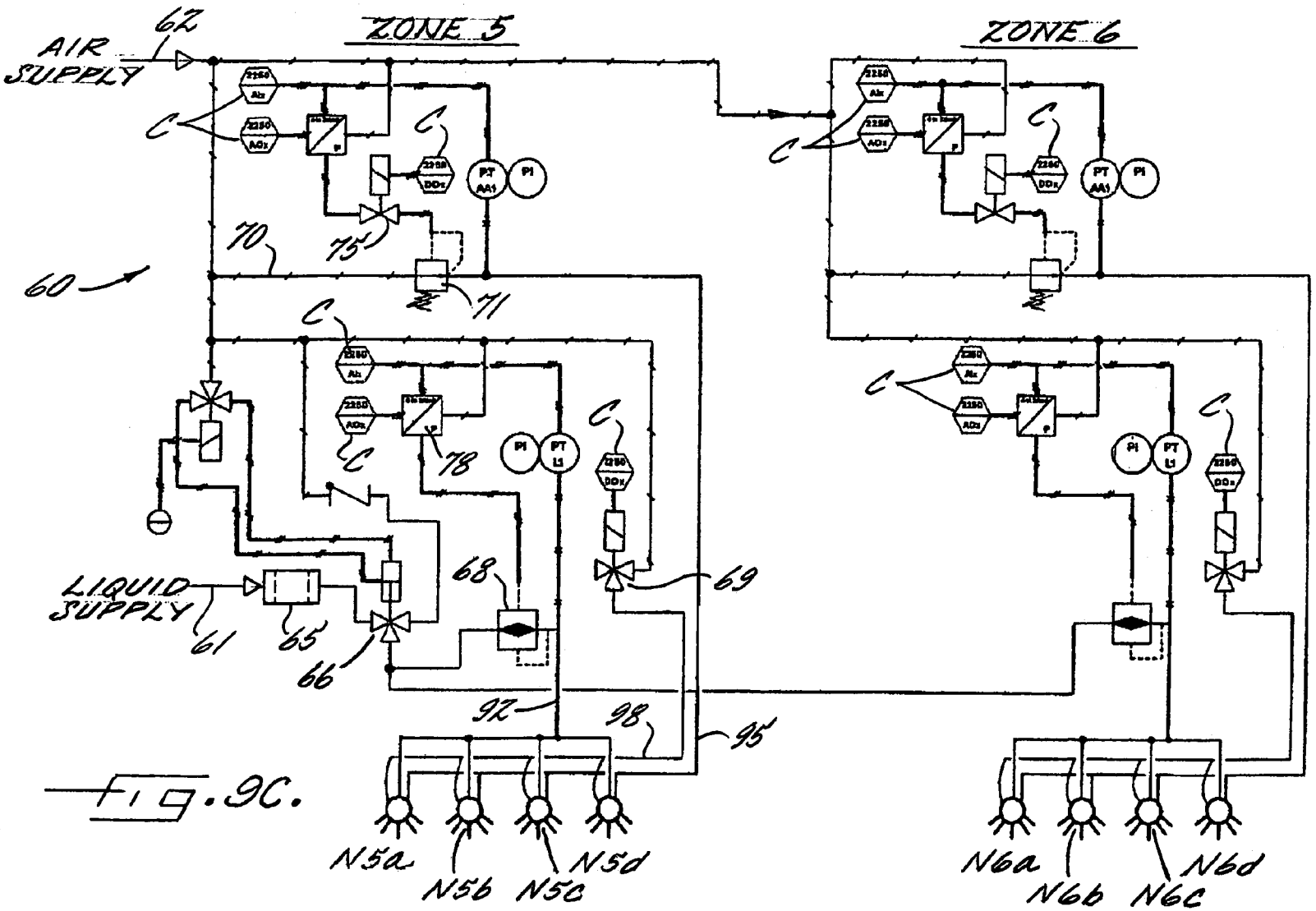

In carrying out an important aspect of the invention, an automatic control system 60 is provided for individually controlling the spray operation of each cooling zone in response to the sensed temperature of the zone for independently cooling each zone or lane of the moving web to a predetermined level and maintaining the temperature at that level. As depicted in FIG. 9A, cooling zones Z1, Z2 are supplied from a common liquid supply 61 and pressurized air supply 62 and are controlled by a common controller C, such as a Model 2250 AutoJet controller, commercially available from Spraying Systems, the assignee of the present application. Since the control systems for zones Z1, Z2 are similar, only one need be described in detail.

With further reference to FIG. 9A, pressurized liquid, such as water, is supplied to the spray nozzles N1*a*, N1*b* of zone Z1 from the main liquid supply 61, which communicates through a filter 65, a three-way control valve 66, a pressure regulator 68, and a two-way (on/off valve) 69 to the liquid supply lines 44 for the nozzles N1*a*, N1*b*. Pressurized air is supplied to the spray nozzles N1*a*, N1*b* from the main air supply 62, through a main supply air line 70 that communicates through a pressure regulator 71 with the pressurized air supply lines 45 for the spray nozzles.

For controlling the pressure of the air supply to the spray nozzles N1*a*, N1*b* a pilot air line 72 communicates with the pressure regulator 71 from the main air supply 70 through an I/P (current to pressure converter) 74 and a two-way on/off valve 75. Upon entry into the controller C of the desired pressure of the atomizing air for a particular spraying operation, the I/P converter 74 will control the appropriate pilot air pressure to the pressure regulator 71 in the main air supply line 70 for effecting such air pressure in the air supply line.

In carrying out the invention, the controller C is operable in response to signals from the temperature sensor T for each cooling zone for controlling the pressure of the liquid to the spray nozzles of the respective zone, and hence, the volume of cooling liquid to be sprayed onto the web for establishing and maintaining a set predetermined target temperature of the web passing through the cooling zone. To this end, an I/P converter 78 is provided in a pilot air line 79 communicating with the main air supply 62 for controlling the pressure regulator 68 for the liquid supply line under the control of the controller C. In response to signals from the temperature sensor T for the cooling zone Z1 to the controller C, dependant upon the previously entered target temperature for the cooling zone Z1, the controller will adjust the I/P converter 78, which in turn will adjust the pressure regulator 68 to increase or decrease the liquid pressure as required to establish and maintain the preset temperature of that zone or lane the web passing the cooling zone Z1. As will be apparent to one skilled in the art, the controller C also can be set to control the on/off valves 69 and 75, and the three-way valve 66 for the liquid supply line can be controlled by a cylinder 81 and three way valve 82. To permit purging in liquid of the liquid supply line such as during periods of non-use, pressurized air can be directed through the liquid supply line upon selected actuation of three-way on/off control valve 66.

During operation of the initial cooling zones Z1, Z2, it can be seen that the individual zones or lanes of the moving web 12 can be individually cooled to a predetermined temperature. Based upon signals from the respective temperature sensors T, the supply of cooling liquid can be individually increased and decreased, under the control of the controller C for establishing maintaining the optimum temperature for the zone cooling. In the illustrated asphalt processing line, the temperature of the web material entering the press roll and cooling station 25 is on the order of 400° F., and the initial cooling zones Z1, Z2 can be set to cool the web material to an interim temperature of about 250° F. Due to the high temperature of the moving web, the liquid spray discharged from the internal mix atomizing nozzles N1*a*, N1*b* and N2*a*, N2*b*, will evaporate in close proximity, or upon impact, with the hot web material, causing relatively quick evaporative cooling and a substantial lowering of the temperature of the moving web.

In keeping with the invention, the cooling system 35 includes a plurality of further cooling zones Z3-Z6 downstream of the initial cooling zones Z1, Z2 for more precisely and evenly cooling the moving web to a predetermined lower temperature across its transverse width prior to direction to the finished product accumulator 31 for processing through the shingle cutter and packing stations 29, 30. The cooling stations Z3-Z6 in this case each are independently controllable for cooling a smaller transverse width lane or zone of the moving web than the initial cooling zones Z1, Z2. In the illustrated embodiment, as depicted in FIG. 2, the downstream cooling zones Z3-Z6 each have a transverse width approximately ½ the width of the initial cooling zones Z1, Z2 and each comprise a plurality of nozzles spaced longitudinally with respect to each other in the direction of travel of the web downstream of the initial cooling zones Z1, Z2 for progressively cooling the relatively smaller transverse width zones of the web to predetermined lower levels as set by the controller.

Figures 6, 7, 8:
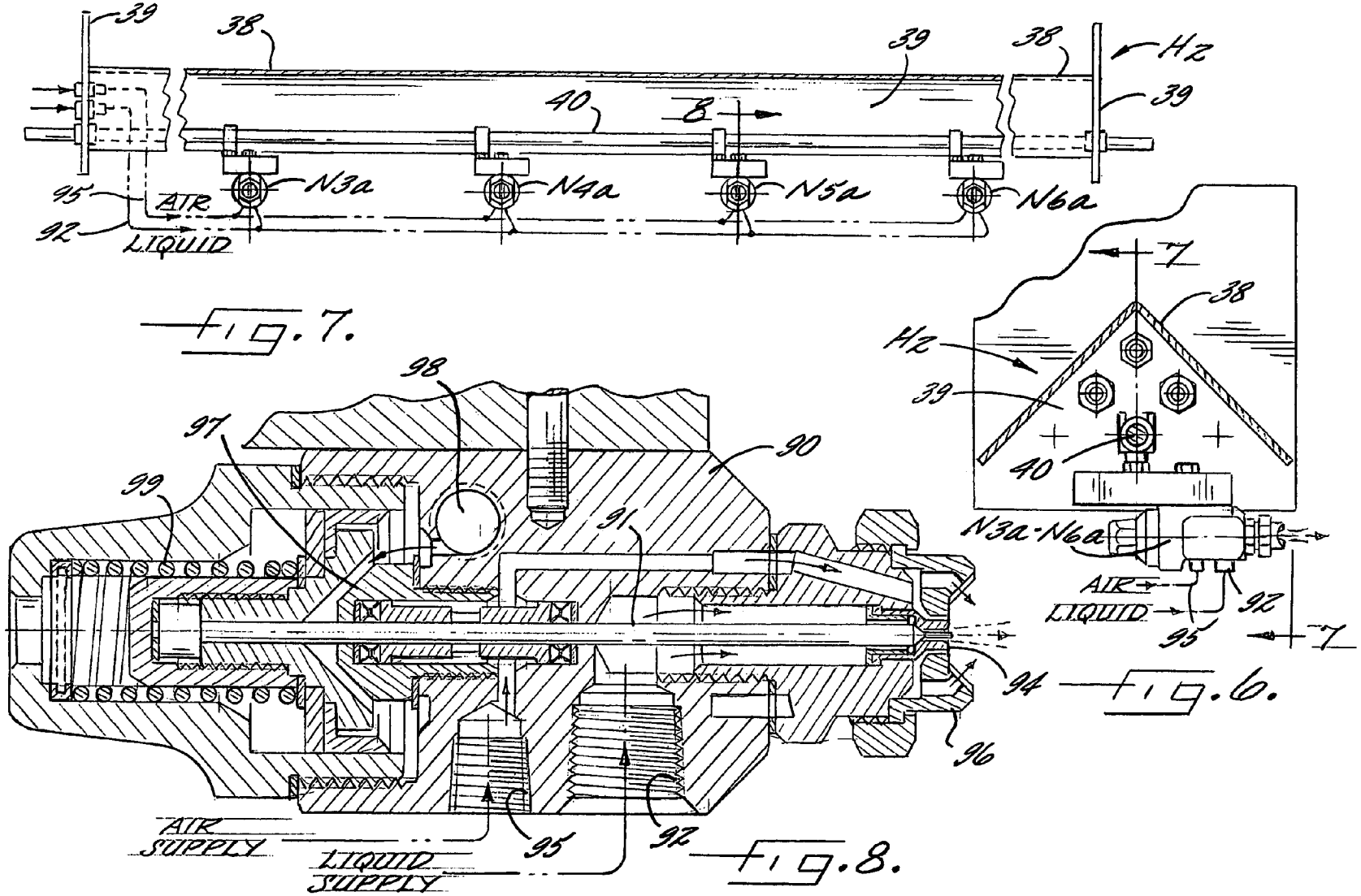
FIG. 6 is an enlarged vertical section of one of the spray nozzle support headers of the illustrated cooling system, taken in the plane of line 6-6 in FIG. 2.
FIG. 7 is a longitudinal section of the spray header shown in FIG. 6, taken in the plane of line FIG. 7-7.
FIG. 8 is an enlarged fragmentary section of one of the spray nozzles or guns used in further downstream cooling zones of the illustrated cooling system, taken in the plane of line 8-8 in FIG. 7.

Each of the illustrated cooling zone Z3-Z6 comprises four spray nozzles N3*a*-N3*d* N4*a*-N4*d*, N5*a*-N5*d* and N6*a*-N6*d* disposed in longitudinally spaced intervals along the length of the moving web in the direction of travel. The spray nozzles of the further cooling zones Z3-Z6 are supported by a plurality of headers H2, H3, H4 and H5 disposed at spaced intervals along the direction of web movement. In this case, a first or upstream spray nozzle N3*a*, N4*a*, N5*a*, N6*a* of each cooling zone Z3-Z6 is supported by a header H2; a second spray nozzle N3*b*, N4*b*, N5*b*, N6*b* of each zone in the direction of web movement is supported by header H3 a third spray nozzle N3*a*, N3*b*, N3*c*, N3*d* of each cooling zone in the direction of web movement is supported by a header H4; and a final spray nozzle N3*a*, N4*b*, N5*c*, N5*d* of each cooling zone in the direction of web movement is supported by a header H5. Similar to cooling zones Z1, Z2, the headers H2-H5 comprise an inverted V-shaped channel 38 with end plates 39 between which a nozzle support rod 40 is mounted (FIGS. 6-7). The headers H2-H5 each support the respective cooling nozzles of each cooling zone Z3-Z6 and the liquid and pressurized air supply lines to each respective nozzle of the zone.

The spray nozzles of cooling zones Z3-Z6 preferably are needle valve-controlled, external-mix air assisted spray nozzles, such as offered by Spraying Systems Co. and disclosed in U.S. application Ser. No. 09/892,138, filed Jan. 26, 2001, assigned to the same assignee as the present application, the disclosure of which is incorporated herein by reference. Basically, each spray nozzle has comprises a housing 90 having an axially reciprocatable valve needle 91, a liquid inlet port 92 for directing cooling liquid into and through the valve housing 90 for discharge from a spray tip 94 thereof, an atomizing air inlet port 95 for directing atomizing air through said housing for discharge from an air cap 96 of the spray nozzle, and a cylinder air inlet 98 port into which pressurized air is directed for operating a piston 97 for effecting controlled axial movement of the valve needle 91 between on and off positions against the biasing force of a spring 99. Such external mix air atomized the spray nozzles are adapted for finely atomizing liquid droplets for efficient cooling of the moving web, while maintaining a constant spray angle over liquid pressure variations. Due to the temperature of the web at such location, the spray discharge from the external mix spray nozzles will impact the moving web to provide efficient convective cooling.

For sensing the temperature of the web downstream of the spray nozzles of the further cooling zone Z3-Z6, each cooling zone has a respective downstream temperature sensor T, again preferably an infrared temperature sensor, disposed approximately at a central location within the respective cooling zone. Temperature sensors T in this case are located immediately prior to the finished product accumulator 31 for the purpose of sensing the temperature of the moving web prior to entering in the finished product accumulator 31 for direction to the cutting and stacking stations 29, 30.

In keeping with the invention, the operation of the spray nozzles for each further cooling zone Z3-Z6 also are independently controlled by the control system 60 based upon the temperature sensed by the respective temperature sensor T for cooling the web in each zone to a preset lower value, such as on the order of 125° F., prior to direction to the finished product accumulator for enabling optimum final processing of the web. In the preferred embodiment, the further cooling zones Z3, Z4 are controlled by a common Spraying Systems Model 2250 controller, and the further cooling zone Z5, Z6 are controlled by a separate common Spraying Systems 2250 controller. Alternatively, it will be understood that a common controller could be used for all of the cooling zones.

The control system 60 for each further cooling zone Z3-Z6 is substantially similar to that described with respect to the initial cooling zones Z1-Z2, and need not be repeated in detail. In this instance, the control system 60 for each further cooling zones Z3-Z6 includes a further pressurized cylinder air line 98 for selectively directing pressurized to spray nozzle and under the control of the controller and a three way valve 69 for controlling operation of the needle valve 91.

From the foregoing, it can be seen that the cooling system of the present invention is effective for cooling the hot moving web material to a preset substantially uniform temperature across its transverse width prior to direction to the further processing stations. The initial cooling zones Z1, Z2 in this case use evaporative cooling as the cooling method, while the further downstream cooling zones Z3-Z6 operate by convective cooling. Each cooling zone has its own set of spray nozzles and its own temperature sensor to monitor the zone temperature according to the setting of the controller. The amount of water delivered to each zone of the web will depend upon the temperature sensed by the respective temperature sensor, as controlled by the controller. The cooling system sprays only enough water to maintain the set point temperature, and as a result, substantially reduces the amount of water usage required for cooling as compared to conventional web cooling systems. It will be understood by one skilled in the art that the control system further may be provided with an OPC object (linking and embedding) server and configurator to allow remote data access and monitoring. The user's Ethernet can be directly connected to the controllers of the cooling systems via an Ethernet to RS-232 converter.

Figure 10:
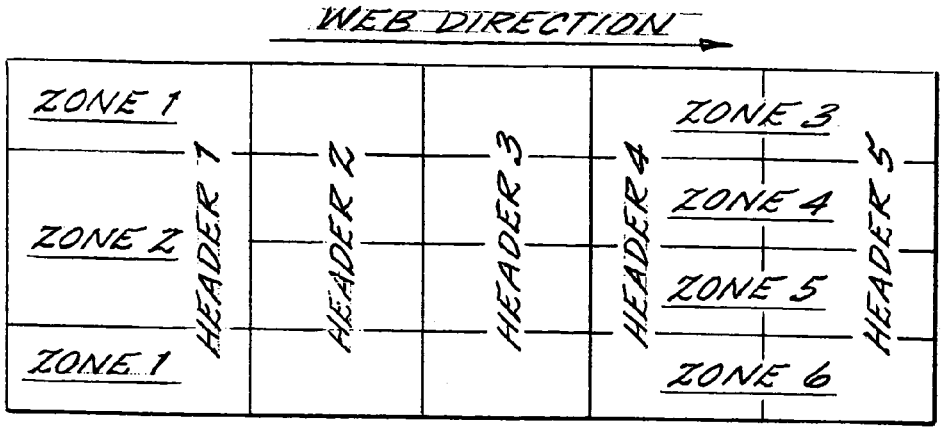
FIG. 10 is a diagram of an alternative cooling zone arrangement for a cooling system in accordance with the invention.

It will be understood by one skilled in the art that alternative arrangements of independently controlled cooling zones maybe implemented for particular spray applications. For example, as depicted in FIG. 10, the initial cooling zones may comprise a central cooling zone Z2 and a pair of peripheral or side cooling zones Z6 each being approximately ½ of the width of the central cooling zone Z2. In this case, the spray nozzles for the individual zones Z1, Z2 may similarly be independently operated and controlled by the control system shown in FIG. 9A.

Figure 11:
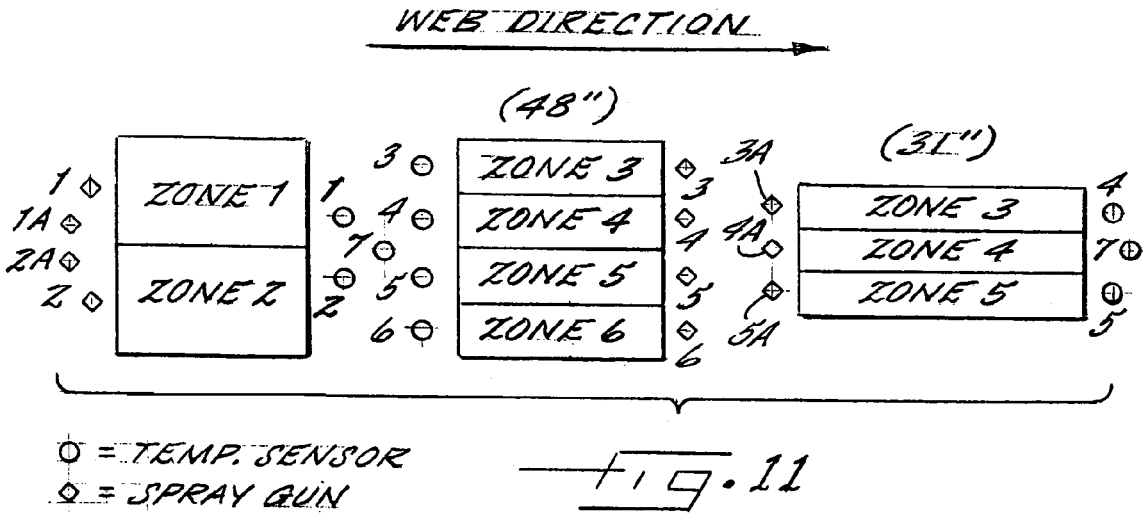
FIG. 11 is a depiction of a cooling system in accordance with the invention that can be used in the processing of webs of different widths.

With reference to FIG. 11, an alternative embodiment of cooling system in accordance with the invention is provided that is adapted for automatically and uniformly cooling webs of alternative transverse widths. The cooling system in this case includes an arrangement of spray nozzles and temperature sensors which are selectively used, dependent upon the width of the web to be processed. For example, in processing a 48 inch width web, cooling zones Z1 and Z2 could be cooled by spray nozzles 1 and 2 under the control of temperature sensors 1 and 2. Zones Z3-Z6 could be cooled by spray nozzles 3-6 under the control of temperature sensors 3-6. For processing 31 inch width web material, zones Z1 and Z2 would be cooled by spray nozzles 1A and 2A under the control of temperature sensors 1 and 2 and zones Z3-Z5 could be cooled by spray nozzles 3A-5A under the control of temperature sensors 4, 7, 5. It will be understood that further alternative arrangements of spray nozzles and temperature sensors may be selectively utilized in a common cooling system under the control of the controller, depending upon the transverse width of the webs to be processed through the line.

From the foregoing, it can be seen that the control system of the present invention is adapted for more efficiently and uniformly cooling moving web and sheet material in continuous production or processing lines. The cooling system is effective for more uniformly cooling the moving web material across the transverse width of the material. The cooling system further is adapted to automatically sense unevenness in temperatures across the width of the material and to adjust operation of the cooling system to affect uniform cooling. The system also optimizes water usage and eliminates handling of excessively applied cooling liquid.

What is claimed is:

1. An apparatus for processing elongated sheet material comprising, a plurality of processing stations through which an elongated length of said sheet material is passed along a direction of travel, said processing stations each being operable for processing the sheet material as it passes through the processing station, said processing stations including an application station for applying a processing medium onto the sheet material, said application station including a plurality of application zones including therein processing medium fluid spray nozzles, each fluid spray nozzle being operable for applying a processing medium to a portion of a transverse width of the sheet material during passage through the application station, at least one of said application zones having a plurality of processing medium fluid spray nozzles disposed at longitudinally spaced intervals in the direction of travel of the sheet material, and at least one of said application zones having a plurality of processing medium fluid spray nozzles disposed width wise across the sheet material transversely to the direction of travel of the sheet material, said applications zones each having a respective sensor for sensing a condition of the respective portion of the transverse width of the moving sheet material, and a controller for independently controlling the operation of each application zone based upon a preset setting of the controller and the condition sensed by the sensor of the respective application zone.

2. The apparatus of claim 1 in which said application zones include a plurality of initial application zones each being operable for directing a processing medium over a portion of the passing sheet material having a first predetermined width, and a plurality of further application zones each being operable for directing a process medium over a portion of the sheet material having a second predetermined transverse width different from said first transverse width.

3. The apparatus of claim 2 in which said further application zones are located downstream of said initial application zones in the direction of travel of said sheet material.

4. The apparatus of claim 3 in which said further application zones each are operable for directing a processing medium over a portion of said passing web having a smaller transverse width than said initial application zones.

5. The apparatus of claim 1 including a plurality of headers disposed in parallel transverse relation to the moving sheet material, said headers each supporting at least one spray nozzle of a plurality of said application zones.

6. The apparatus of claim 5 in which said spray nozzles each are air atomizing spray nozzles, and said headers each further support pressurized air and liquid supply lines to the nozzles supported thereon.

7. The apparatus of claim 1 in which said fluid spray nozzles of at least one of said application zones are operable for directing liquid onto a central portion of said sheet material, and said fluid spray nozzles of a second of said application zones is operable for directing cooling fluid onto peripheral portions of said sheet material on opposite sides of said central portion.

8. An apparatus for processing elongated sheet material comprising, a plurality of processing stations through which an elongated length of said sheet material is passed, said processing stations each being operable for processing the sheet material as it passes through the processing station along a direction of travel, said processing stations including a cooling station for lowering the temperature of said sheet material, said cooling station including a plurality of cooling zones including therein processing medium fluid spray nozzles, each fluid spray nozzle being operable for cooling a portion of a transverse width of the sheet material during passage through the cooling station, said cooling zones including an initial cooling zone having a first predetermined number of fluid spray nozzles operable for directing a cooling fluid over a portion of the processing sheet having a first pre-determined width, and at least one further cooling zone having a second predetermined number of fluid spray nozzles different from said first predetermined number operable for directing cooling fluid over a portion of the sheet material having a second predetermined transverse width different from said first transverse width, at least one of said cooling zones having a plurality of processing medium fluid spray nozzles disposed at longitudinally spaced intervals in the direction of travel of the sheet material, and at least one of said cooling zones having a plurality of processing medium fluid spray nozzles disposed width wise across the sheet material transversely to the direction of travel of the sheet material, said cooling zones each having a sensor for sensing the temperature of a respective portion of the transverse width of the moving sheet material, and a controller for independently controlling the operation of each cooling zone based upon a preset temperature settings of the controller and the temperature sensed by the temperature sensor of the respective cooling zone.

9. The apparatus of claim 8 in which said at least one further cooling zone is located downstream of said initial cooling zone in the direction of travel of said sheet material.

10. The apparatus of claim 9 in which said at least one further cooling zone is operable for directing a cooling fluid over a portion of said passing web having a smaller transverse width than said initial cooling zone.

11. The apparatus of claim 8 in which some of said cooling zones are operable for directing a cooling fluid toward said moving sheet material for cooling the sheet material by evaporative cooling, and other of said cooling stations are operable for directing the cooling fluid toward the sheet material for cooling the sheet material by conductive cooling.

12. An apparatus for processing elongated sheet material comprising, a plurality of processing stations through which an elongated length of said sheet material is passed, said processing stations each being operable for processing the sheet material as it passes through the processing station along a direction of travel, said processing stations including a cooling station for lowering the temperature of said sheet material, said cooling station including a plurality of cooling zones including therein processing medium fluid spray nozzles, each fluid spray nozzle being operable for cooling a portion of a transverse width of sheet material during passage through the cooling station, at least one of said cooling zones having a plurality of processing medium fluid spray nozzles disposed at longitudinally spaced intervals in the direction of travel of the sheet material, and at least one of said cooling zones have a plurality of processing medium fluid spray nozzles disposed width wise across the sheet material transversely to the direction of travel of the sheet material, said cooling zones each having a respective temperature sensor for sensing the temperature of the portion of the sheet material onto which a cooling fluid has been directed by the least one spray nozzle of the respective cooling zone, and a controller responsive to the temperature sensed by the temperature sensor of each cooling zone for independently controlling the flow of cooling fluid to the at least one spray nozzle of each cooling zone based upon a preset temperature setting of the controller.

13. The apparatus of claim 12 in which said cooling zones each include said plurality of liquid spray nozzles for simultaneously directing cooling fluid onto the respective portion of the sheet material passing the cooling zone.

14. The apparatus of claim 12 in which said cooling zones include a plurality of initial cooling zones each being operable for directing a cooling fluid over a portion of the passing sheet material having a first predetermined width, and a plurality of further cooling zones each being operable for directing cooling fluid over a portion of the sheet material having a second predetermined transverse width different said first transverse width.

15. The apparatus of claim 14 in which said further cooling zones are located downstream of said initial cooling zones in the direction of travel of said sheet material.

16. The apparatus of claim 15 in which said further cooling zones each are operable for directing a cooling fluid over a portion of said passing web having a smaller transverse width than said initial cooling zones.

17. The apparatus of claim 16 in which said initial cooling zones are operable for spraying a cooling fluid over a portion of said sheet material corresponding to about one-half the transverse width of the sheet material, and said further cooling zones are operable for directing cooling fluid over a portion of said sheet material corresponding to about one-quarter of the transverse width of the sheet material.

18. The apparatus of claim 12 in which said cooling zones include a plurality of initial cooling zones having at least one spray nozzle, and a plurality of further cooling zones downstream of said initial cooling zones in the direction of travel of the sheet material which each include said plurality of spray nozzles.

19. The apparatus of claim 18 in which said further cooling zones each have a greater number of spray nozzles than said initial cooling zones.

20. The apparatus of claim 12 in which at least some of said cooling zones have spray nozzles of a first type operable for directing cooling fluid toward the moving sheet material for evaporative cooling of the sheet material, and other of said cooling zones have spray nozzles of a second type different from said first type operable for directing cooling fluid toward the moving sheet material for convective cooling the sheet material.

21. The apparatus of claim 20 in which the nozzles of said first type are internal mix air atomizing spray nozzles in which pressurized air and liquid flow streams are internally mixed within the spray nozzle for discharge toward the moving sheet material, and the spray nozzles of a second type are external mix air atomizing spray nozzles in which pressurized air and liquid streams are intermixed and atomized upon discharge from the spray nozzle toward the moving sheet material.

22. The apparatus of claim 12 including a plurality of headers disposed in parallel transverse relation to the moving sheet material, said headers each supporting at least one spray nozzle of a plurality of said cooling zones.

23. The apparatus of claim 22 in which said spray nozzles each are air atomizing spray nozzles, and said headers each further support pressurized air and liquid supply lines to the nozzles supported thereon.

24. The apparatus of claim 23 in which said headers each protectively overlie the spray nozzles and liquid and pressurized air lines supported thereby.

25. The apparatus of claim 12 in which at least one of said cooling zones is operable for directing liquid onto a central portion of said sheet material, and a second of said cooling zones is operable for directing cooling fluid onto peripheral portions of said sheet material on opposite sides of said central portion.

26. An apparatus for making asphalt shingles comprising, an unwind station from which a continuous length of sheet material is drawn, a plurality of processing stations through which the drawn sheet material is directed, said processing stations including a coating station at which a hot liquid coating is applied to the sheet material as the sheet material passes through a coating station along a direction of travel;

a surfacing station in which a granular surface material is applied to the coated sheet material as the coated sheet material passes through the surfacing station, a press roll station including a press roll for pressing granular surface material into the coated sheet material, a cooling station for lowering the temperature of said sheet material as it passes the cooling station, said cooling station including a plurality of independently controllable cooling zones including therein liquid spray nozzles, said spray nozzles of each cooling zone being operable for directing a fluid toward and cooling a portion of a first transverse width of the sheet material during passage through the cooling station, at least one of said cooling zones having a plurality of liquid spray nozzles disposed at longitudinally spaces intervals in the direction of travel of the sheet material, and at least one of said cooling zones having a plurality of liquid spray nozzles disposed width wise across the sheet material transversely to the direction of travel of the sheet material, and a cutting station in which the cooled sheet material is cut into individual shingles.

27. The apparatus of claim 26 in which at least some of said cooling zones are located immediately prior to the press roll for cooling the coated sheet material to a predetermined lower temperature prior to passage by said press roll.

28. The apparatus of claim 27 including further cooling zones located downstream of said initial cooling stations and press roll for cooling said sheet material to a further lower temperature prior to direction to said cutting station.

29. The apparatus of claim 26 in which said cooling zones include a plurality of initial cooling being each operable for directing a cooling fluid over a portion of the passing sheet material having a first predetermined width, and a plurality of further cooling zones each being operable for directing cooling fluid over a portion of the sheet material having a second predetermined transverse width different said first transverse width.

30. The apparatus of claim 29 including a first plurality of said cooling zones being operable for cooling sheet material having a first predetermined width, and a second plurality of said cooling zones being operable for cooling sheet material having a second predetermined width, and at least some of the cooling zones of the first plurality have a spray nozzle common to that of a cooling zone of the second plurality.

31. The apparatus of claim 30 in which some of the cooling zones of the first plurality include a temperature sensor common to a cooling zone of the second plurality.

32. The apparatus of claim 26 in which said further cooling zones are located downstream of said initial cooling zones in the direction of travel of said sheet material and each are operable for directing a cooling fluid over a portion of said passing web having a smaller transverse width than said initial cooling zones.

33. The apparatus of claim 26 in which each said cooling zone includes at least one liquid spray nozzle for directing a cooling fluid onto the respective portion of the sheet material passing the cooling zone, said cooling zones each having a respective temperature sensor for sensing the temperature of the portion of the sheet material onto which a cooling fluid has been directed by the at least one spray nozzle of the respective cooling zone, and said controller being responsive to the temperature sensed by the temperature sensor of each cooling zone for independently controlling the flow of cooling fluid to the at least one spray nozzle of each cooling zone based upon the preset temperature setting of the controller.

34. The apparatus of claim 33 in which some of said cooling zones are operable for cooling sheet material having a first predetermined width, and other of said cooling zones are operable for cooling sheet material having a second predetermined width different from the first predetermined width.

35. An apparatus for processing elongated sheet material comprising, a plurality of processing stations through which an elongated length of said sheet material is passed, said processing stations each being operable for processing the sheet material as it passes through the processing station, said processing stations including an application station for applying a processing medium onto the sheet material, said application station including a plurality of application zones including therein processing medium fluid spray nozzles, each spray nozzle being operative for applying a processing medium to a portion of a transverse width of the sheet material during passage through the application station, said application zones each further including at least one air atomizing spray nozzle, said applications zones each having a respective sensor for sensing a condition of the respective portion of the transverse width of the moving sheet material, a controller for independently controlling the operation of each application zone based upon a preset setting of the controller and the condition sensed by the sensor of the respective application zone, said controller being part of a control system for a plurality of said application zones, and said control system for each application zone including a respective air pressurize regulator controlled pursuant to a predetermined setting of said controller for controlling the pressure of air supplied to the spray nozzles of the application zone and a liquid pressure regulator controlled by the controller pursuant to a preset liquid pressure setting of the controller for controlling the pressure of liquid to the spray nozzles of the application zone.

36. The apparatus of claim 35 in which each application zone includes a current to pressure converter operable by said controller for controlling the operation of said air pressure regulator and a second current to pressure converter operable by said controller for controlling the operation of said liquid pressure regulator.

37. An apparatus for processing elongated sheet material comprising, a plurality of processing stations through which an elongated length of said sheet material is passed, said processing stations each being operable for processing the sheet material as it passes through the processing station, said processing stations including a cooling station for lowering the temperature of said sheet material, said cooling station including a plurality of cooling zones each for cooling a portion of transverse width of sheet material during passage through the cooling station, each cooling zone including at least one air atomizing liquid spray nozzle for directing a cooling fluid onto the respective portion of the sheet material passing the cooling zone, said cooling zones each having a respective temperature sensor for sensing the temperature of the portion of the sheet material onto which a cooling fluid has been directed by the least one spray nozzle of the respective cooling zone, and a controller responsive to the temperature sensed by the temperature sensor of each cooling zone for independently controlling the flow of cooling fluid to the at least one spray nozzle of each cooling zone based upon a preset temperature setting of the controller, said controller being part of a control system for a plurality of said cooling zones, and said control system for each cooling zone including a respective air pressurize regulator controlled pursuant to a predetermined setting of said controller for controlling the pressure of air supplied to the spray nozzles of the cooling zone and a liquid pressure regulator controlled by the controller pursuant to a preset liquid pressure setting of the controller for controlling the pressure of cooling liquid to the spray nozzles of the cooling zone.

38. The apparatus of claim 37 in which the spray nozzles of some of said cooling zones are of a first type having a reciprocatable valve needle for controlling the spray discharge, said valve needle being moved to an open position in response to the direction of pressurized fluid to the spray nozzle, and said control system being operable for controlling the direction of pressurized fluid to the nozzles of the first type for controlling reciprocating movement of the valve needles thereof.

39. The apparatus of claim 37 in which each cooling zone includes a current to pressure converter operable by said controller for controlling the operation of said air pressure regulator and a second current to pressure converter operable by said controller for controlling the operation of said cooling fluid pressure regulator.

* * * * *